US006439200B1

(12) United States Patent
Majewski et al.

(10) Patent No.: US 6,439,200 B1
(45) Date of Patent: Aug. 27, 2002

(54) CONTROL STRATEGY FOR A THROTTLED INLET, HIGH PRESSURE, DIESEL ENGINE OIL PUMP

(75) Inventors: Michael A. Majewski, Joliet; Steve J. Dickerson, Lake in the Hills; John J. Bryjak, Park Ridge, all of IL (US)

(73) Assignee: International Engine Intellectual Property Company, L.L.C., Warrenville, IL (US)

( * ) Notice: Subject to any disclaimer, the term of this patent is extended or adjusted under 35 U.S.C. 154(b) by 0 days.

(21) Appl. No.: 09/931,359

(22) Filed: Aug. 16, 2001

(51) Int. Cl.[7] ..... F02M 37/04
(52) U.S. Cl. ..... 123/446; 123/458
(58) Field of Search ..... 123/446–7, 506, 123/357, 458, 497

(56) References Cited

U.S. PATENT DOCUMENTS 5,609,136 A * 3/1997 Tuken ..... 123/357
5,727,515 A * 3/1998 Biester ..... 123/458
6,016,791 A * 1/2000 Thomas et al. ..... 123/497
6,085,727 A * 7/2000 Nakano ..... 123/447
6,227,167 B1 5/2001 Smith et al.
6,293,757 B1 * 9/2001 Oda et al. ..... 123/497
6,298,830 B1 * 10/2001 Kono ..... 123/478

OTHER PUBLICATIONS

Kevin Jost, "New Diesel V8 For S–Class," Automotive Engineering International, Jan. 2001, pp. 78–80.

* cited by examiner

*Primary Examiner*—Thomas N. Moulis
(74) *Attorney, Agent, or Firm*—Dennis Kelly Sullivan; Jeffrey P. Calfa; Neil T. Powell

(57) ABSTRACT

A control strategy for a throttled inlet oil pump that supplies high-pressure oil to a rail that serves fuel injectors of a diesel engine. A processor processes certain data to develop data for selectively restricting the throttle at the pump inlet. The processor develops error data defining error between a desired injector control pressure in the rail and actual injector control pressure in the rail. For a prevailing value of the error data, the processor adds a correlated offset data value to introduce an offset into the prevailing error data value, thereby creating an offset error data value. The processor further processes the offset error data value to create a value for the data that establishes the throttle restriction.

6 Claims, 2 Drawing Sheets

| FEED FORWARD TABLE | | | | | | | | | | | FF_OFFSET_TABLE | |
|---|---|---|---|---|---|---|---|---|---|---|---|---|
| OIL FLOW | | | | ICP_DES [MPa] | | | | | | | ICP_ERR | |
| L/min | 4 | 6 | 8 | 10 | 12 | 14 | 16 | 18 | 20 | | [MPa] | OFFSET |
| 1 | 0.56 | 0.57 | 0.60 | 0.58 | 0.58 | 0.67 | 0.68 | 0.59 | 0.65 | | 22 | 0.5 |
| 2 | 0.60 | 0.61 | 0.63 | 0.62 | 0.63 | 0.70 | 0.70 | 0.63 | 0.68 | | 10 | 0.2 |
| 3 | 0.65 | 0.65 | 0.67 | 0.67 | 0.68 | 0.73 | 0.72 | 0.66 | 0.70 | | 5 | 0.15 |
| 4 | 0.69 | 0.70 | 0.70 | 0.72 | 0.73 | 0.75 | 0.74 | 0.70 | 0.73 | | 4 | 0.1 |
| 5 | 0.74 | 0.74 | 0.73 | 0.76 | 0.77 | 0.78 | 0.76 | 0.73 | 0.76 | | 3 | 0.05 |
| 6 | 0.79 | 0.78 | 0.77 | 0.81 | 0.82 | 0.80 | 0.78 | 0.77 | 0.79 | | 2 | 0.025 |
| 7 | 0.83 | 0.83 | 0.80 | 0.86 | 0.87 | 0.83 | 0.80 | 0.81 | 0.82 | | 1 | 0.02 |
| 8 | 0.88 | 0.87 | 0.83 | 0.90 | 0.91 | 0.86 | 0.83 | 0.84 | 0.85 | | 0.5 | 0.01 |
| 9 | 0.92 | 0.91 | 0.87 | 0.95 | 0.96 | 0.88 | 0.85 | 0.88 | 0.88 | | 0 | 0 |
| 10 | 0.97 | 0.95 | 0.90 | 1.00 | 1.01 | 0.91 | 0.87 | 0.91 | 0.91 | | -0.5 | 0.01 |
| 11 | | 1.00 | 0.93 | | | 0.93 | 0.89 | 0.95 | 0.94 | | -1 | 0.02 |
| 12 | | | 0.97 | | | 0.96 | 0.91 | 0.99 | 0.96 | | -2 | 0.025 |
| 13 | | | 1.00 | | | 0.99 | 0.93 | | 0.99 | | -3 | 0.05 |
| 14 | | | | | | | 0.95 | | | | -4 | 0.1 |
| 15 | | | | | | | 0.97 | | | | -5 | 0.15 |
| 16 | | | | | | | 0.99 | | | | -10 | 0.2 |
| | | | | | | | | | | | -22 | 0.5 |

FIG. 2

CONTROL STRATEGY FOR A THROTTLED INLET, HIGH PRESSURE, DIESEL ENGINE OIL PUMP

FIELD OF THE INVENTION

This invention relates generally to diesel engines that power automotive vehicles such as trucks. In particular it relates to a system and method for improving the response of a high-pressure oil pump that delivers oil to a rail that serves engine fuel injectors.

BACKGROUND AND SUMMARY OF THE INVENTION

A high-pressure pump that delivers high-pressure oil for the operation of certain devices on a diesel engine, such as fuel injectors, may be driven directly by the engine. For example, the high-pressure oil may be delivered to a rail that serves the fuel injectors. The pressure in the rail, and hence pump pressure is regulated by relieving pump oil to a sump. The relieved oil serves no particular purpose, and hence may be considered a necessary inefficiency in operating the engine.

An alternative that is the subject of inventive activity involves using a throttled inlet pump. Such a pump does not spill high-pressure oil to the sump because the pressure at the pump outlet, and hence pressure in the rail, are controlled by selectively throttling the pump inlet. The pump inlet through which oil is drawn from the sump comprises a variable throttle that is electrically controlled to selectively throttle the oil entering the pump so as to cause the pump to deliver oil at a desired regulated pressure without spilling to the sump.

Different engine operating conditions call for the development of different pump outlet pressures, and so an ability to change pressure by electric control of the pump inlet throttle is desirable. While this throttled inlet pump is capable of producing a variable pump outlet pressure in conjunction with improved operating efficiency, certain aspects of engine operation may require that pump outlet pressure be changed especially quickly and with accuracy. Because the pump is being driven directly by the engine, engine speed change may also be a factor in pump operation.

A modern diesel engine also comprises an electronic control that is processor-based and processes certain data to develop data used in control of various aspects of engine operation. Such a control can control operation of a throttled inlet oil pump.

It was discovered that a certain throttled inlet pump under development for use with a diesel engine because of certain desirable attributes was unable to achieve desired response to changes in processed data calling for change in pump outlet pressure.

The present invention relates to a solution that is embodied in control strategy for the pump, rather than a solution involving modification of the pump design. The inventive solution has obvious advantages because it can be embodied in software that is programmable.

One aspect of the present invention relates to a control for a throttled inlet oil pump to control oil pressure in a rail that serves injectors of a diesel engine. The control comprises a processor that processes certain data to develop data for selectively restricting a throttle at the pump inlet. The processor processes data to develop error data defining error between a desired injector control pressure in the rail and actual injector control pressure in the rail. The processor further comprises offset data values correlated with values of the error data and adds a correlated offset data value to a prevailing value of error data to introduce an offset into the prevailing error data value. This creates an offset error data value. The processor further processes the offset error data value to create a value for the data that establishes the extent of throttle restriction.

Another aspect of the present invention relates to a strategy for control for a throttled inlet oil pump as described above.

The foregoing, along with further features and advantages of the invention, will be seen in the following disclosure of a presently preferred embodiment of the invention depicting the best mode contemplated at this time for carrying out the invention. The disclosure includes accompanying drawings, briefly described as follows.

BRIEF DESCRIPTION OF THE DRAWINGS

FIG. 2 is a table of representative data obtained from an engine incorporating the inventive strategy.

DESCRIPTION OF THE INVENTION

Figure 1:
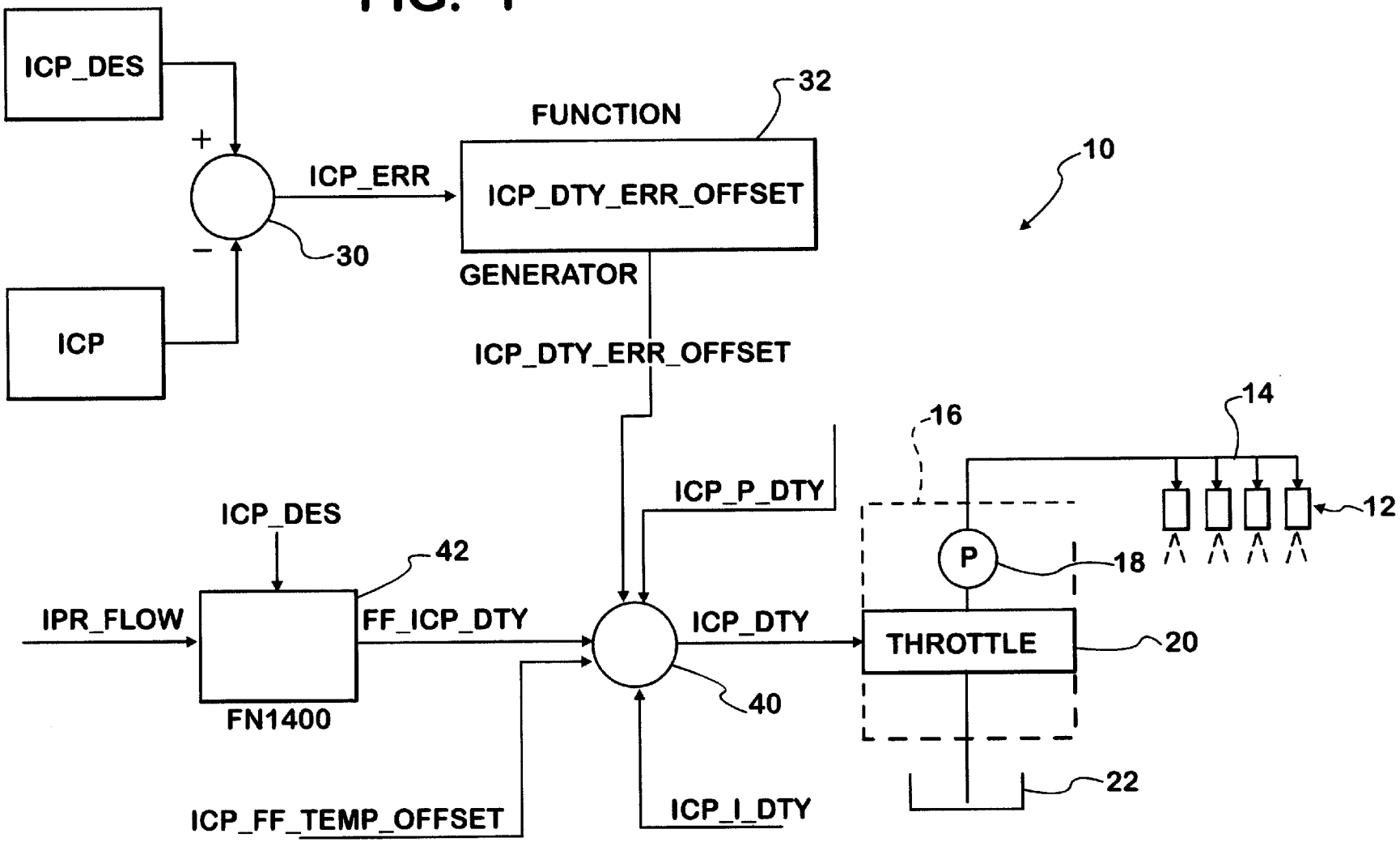
FIG. 1 is a schematic diagram representing an exemplary software implementation of the inventive strategy in an electronic engine control comprising a processor for processing data to develop data for controlling a throttled inlet, high pressure, diesel engine oil pump.

FIG. 1 shows a diesel engine 10 having a fuel system that comprises a number of fuel injectors 12 that inject fuel into the engine cylinders at appropriate times in the engine cycle. A high-pressure rail 14 serves all fuel injectors 12. High-pressure oil is maintained in rail 14 by a throttled inlet pump 16 that comprises a pumping mechanism 18 and a variable throttle 20 in the pump inlet leading to the pumping mechanism. Pumping mechanism 18 is driven by engine 10 as the engine operates. The pressure at the pump outlet, and hence pressure in rail 14, is controlled by selectively throttling the pump inlet via throttle 20. Throttle 20 is electrically controlled to selectively throttle the pump inlet as oil is drawn from a sump 22. This causes pump 16 to deliver oil at a desired regulated pressure to rail 14, and hence fuel injectors 12, without the waste of spilling oil back to the sump.

Engine 10 further comprises an electronic control that is processor-based and processes certain data to develop data used in control of various aspects of engine operation, including control of throttle 20. The inventive strategy for throttled inlet pump control is implemented in the software of the electronic engine control.

Because the outlet of pump 16 delivers oil directly to rail 14 serving fuel injectors 12, the rail pressure and the pump outlet pressure are understood to be essentially identical. That pressure is also sometimes referred to as injector control pressure, or ICP.

The engine electronic control establishes, via processing of certain data, a value for desired injector control pressure or ICP_DES. A value representing actual injector control pressure, or ICP, is developed or obtained in any suitably appropriate manner either by processing various data to derive the value or by a sensor that directly senses the pressure in the rail or at the pump outlet to develop the value.

The processor subtracts (reference numeral 30) the value of ICP from the value of ICP_DES to develop an error signal ICP_ERR that is used in closed loop control of throttle 20. As pump 16 is mechanically driven by the engine and throttle 20 selectively restricted by a duty cycle control signal $ICP_{13}$ DTY, the pump outlet pressure is regulated to the desired injector control pressure. Values for duty cycle control signal ICP_DTY are developed by processing values for certain data, including values for $ICP_{13}$ ERR.

$ICP_{13}$ ERR forms an input to a function generator 32 that correlates values of a function ICP_DTY_ERR_OFFSET with values of ICP_ERR. What function generator 32 does is add a certain offset to ICP_ERR depending on the value of ICP_ERR. In general, the larger the magnitude of the error, the larger the offset that is added. The result is a value designated ICP_DTY_ERR_OFFSET. The two right-hand columns of FIG. 2 show representative offsets for representative errors. Moreover, the columns show that the offset is always positive regardless of whether ICP_ERR is positive or negative. The offset creates a tendency of the control to overshoot a steady state target value for injector control pressure when input data calls for a change in that pressure. As a result, a faster response is attained. Faster response may be beneficial in achieving compliance with relevant specifications, such as emission-related ones.

ICP_DTY_ERR_OFFSET is one of several data values that are summed together (reference numeral 40) to create ICP_DTY. The other data values include FF_ICP_DTY, ICP_FF_TEMP_OFFSET, $ICP_P_{13}$ DTY, and $ICP_{13}$ $I_{13}$ DTY.

A value for FF_ICP_DTY is obtained from a look-up table 42 containing values correlated with sets of various values for ICP_DES and a variable parameter IPR_FLOW. ICP_FF_TEMP_OFFSET is a parameter that accounts for temperature influence on oil pressure. ICP_P_DTY and $ICP_{13}$ $I_{13}$ DTY are feedback values used for proportional and integral control.

While a presently preferred embodiment of the invention has been illustrated and described, it should be appreciated that principles of the invention are applicable to all embodiments and uses that fall within the scope of the following claims.

What is claimed is:

1. A control for a throttled inlet oil pump to control oil pressure in a rail that serves injectors of a diesel engine, the control comprising:

a processor that processes certain data to develop data for selectively restricting a throttle at the pump inlet, the processor processing data to develop error data defining error between a desired injector control pressure in the rail and actual injector control pressure in the rail; and wherein the processor further comprises offset data values correlated with values of the error data, the processor adds a correlated offset data value to a prevailing value of error data to introduce an offset into the prevailing error data value thereby creating an offset error data value, and the processor further processes the offset error data value to create a value for the data that establishes the throttle restriction.

2. A control as set forth in claim 1 wherein the offset data values are positive for both positive and negative values of error data.

3. A control as set forth in claim 1 wherein the processor further processes the offset error data value with further values correlated with proportional and integral values of actual injector control pressure and with oil temperature to create the value for the data that establishes the throttle restriction.

4. A strategy for control for a throttled inlet oil pump to control oil pressure in a rail that serves injectors of a diesel engine, the strategy comprising:

processing certain data to develop data for selectively restricting a throttle at the pump inlet, including processing data to develop error data defining error between a desired injector control pressure in the rail and actual injector control pressure in the rail; and processing offset data values correlated with values of the error data by adding a correlated offset data value to a prevailing value of error data to introduce an offset into the prevailing error data value thereby creating an offset error data value, and processing the offset error data value to create a value for the data that establishes the throttle restriction.

5. A strategy as set forth in claim 4 wherein the offset data values are positive for both positive and negative values of error data.

6. A strategy as set forth in claim 4 wherein including further processing the offset error data value with further values correlated with proportional and integral values of actual injector control pressure and with oil temperature to create the value for the data that establishes the throttle restriction.

* * * * *